US006227885B1

(12) United States Patent
Raviv et al.

(10) Patent No.: US 6,227,885 B1
(45) **Date of Patent: *May 8, 2001**

(54) QUICK CONNECT ELECTRODE HEADBOX

(76) Inventors: Gabriel Raviv, 1048 Woodlawn, Glenview, IL (US) 60025; Robert Tarasewicz, 711 59th St., Lisle, IL (US) 60532

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/280,154

(22) Filed: Mar. 26, 1999

(51) Int. Cl.[7] ..... H01R 13/44
(52) U.S. Cl. ..... 439/131
(58) Field of Search ..... 439/131

(56) References Cited

U.S. PATENT DOCUMENTS

| | | | | |
|---|---|---|---|---|
| 3,950,053 | * | 4/1976 | Brighenti | 439/131 |
| 4,051,842 | | 10/1977 | Hazel et al. . | |
| 4,094,307 | | 6/1978 | Young, Jr. . | |
| 4,986,762 | * | 1/1991 | Keith | 439/131 |
| 5,087,208 | * | 2/1992 | Chang | 439/224 |
| 5,205,286 | | 4/1993 | Soukup et al. . | |
| 5,265,607 | | 11/1993 | Moberg | 128/639 |
| 5,326,272 | | 7/1994 | Harhen et al. | 128/641 |
| 5,362,243 | * | 11/1994 | Huss | 439/76.1 |
| 5,479,934 | | 1/1996 | Imran | 128/644 |
| 5,575,668 | * | 11/1996 | Timmerman | 439/131 |
| 5,613,874 | * | 3/1997 | Orlando et al. | 439/491 |
| 5,701,895 | | 12/1997 | Prutchi et al. | 128/630 |

* cited by examiner

*Primary Examiner*—Neil Abrams
(74) *Attorney, Agent, or Firm*—Marshall, O'Toole Gerstein, Murray & Borun

(57) ABSTRACT

A novel quick connect electrode headbox is provided with an internal assembly positioned within a housing. The internal assembly has at least one support and a plurality of pivotable electrode receptacle bases pivotably mounted to the at least one support. Further, the plurality of pivotable electrode receptacle bases have a plurality of receptacles each adapted to receive an electrode connector.

15 Claims, 4 Drawing Sheets

QUICK CONNECT ELECTRODE HEADBOX

FIELD OF THE INVENTION

The present invention relates to electrode headboxes, and more particularly to electrode headboxes that provide for quick and easy connection and disconnection of electrodes and provide for enhanced viewing and identification of electrode labels.

BACKGROUND OF THE INVENTION

Electrodes are placed at specific locations on a patient's body to sense signals occurring at the locations and are connected to a monitoring instrument to produce useful physiological output information such as an electrocardiogram (ECG), electroencephalogram (EEG) or long-term epilepsy monitoring. Electrodes typically are connected to devices which record, analyze, display, process, or otherwise monitor signals delivered by the electrodes. Electrode headboxes are commonly used to provide a convenient interface between the numerous electrodes and the monitoring device.

Electrode headboxes of various types are known in the art. Such devices are used in the fields of medicine and physiology. Conventional headboxes include a box with numerous connectors configured to receive electrodes. Headboxes are difficult to work with once several electrodes are in place in the headbox because the electrodes are small and difficult to reach by a user when the electrodes are spaced very close together in the headbox. Further, electrodes are frequently damaged when a user attempts to reach an electrode that is closely surrounded by many other electrodes that are connected to a headbox. In mobile applications, conventional headbox configurations result in undue stress and damage to the electrode connector assembly.

In the prior art, a headbox is typically connected to a switch panel on a monitoring machine, e.g. EEG machine. The machines have an array of switches which allow connections, through the headbox, of any electrode to any channel input of the EEG machine. This array of switches may be controlled manually or by computer software. EEG technologists place electrodes on a patient's head, connect the electrodes to the headbox that in turn is connected to the EEG machine input channels, and set up the EEG machine for the particular medical procedure being performed.

Conventional EEG machines and more specialized brain wave monitors are difficult to use by those not trained in EEG technology, in part due to the setup procedures involved. Such difficulties associated with EEG monitoring procedures include connecting the electrodes into the correct location in the headbox for each different monitoring procedure; and having to set up another monitor with the same parameters when the patient is moved from one room to another room. Similar difficulties are also found in other types of monitoring. This procedure is more difficult when many electrodes are connected to the headbox. In this situation, it becomes increasingly difficult to connect or disconnect electrodes from the headbox because the electrodes are spaced very close together when connected to the headbox. Further, when the electrodes are spaced close together, the labels on the headbox inputs are frequently not readable because the electrodes obstruct them from view.

The present invention overcomes these and other problems inherent in existing headboxes. The present invention provides an electrode headbox that provides for easy and quick connection (and disconnection) of the electrodes to the headbox. The headbox may, for example, be used in brain wave monitoring using electrodes that are attached to a patient's head and connected through a headbox to an EEG machine. In this application, the headbox provides a convenient interface between the EEG machine and surface or intracranial electrodes. Surface and intracranial electrode assemblies used for EEG typically comprise a metal disk which is attached to a patient's head or a needle which is inserted into a patient's head. The disk or needle is connected to one end of a wire conductor which has a connector portion such as a standard pin plug connected to the other end of a wire conductor. This connector portion is adapted to be detachably connected to a mating connector portion in the headbox, such as a pin connector. Such electrode assemblies are typically termed as "electrodes", and will be referred to as such in this disclosure. Accordingly, it is an object of the present invention to provide a novel quick connect electrode headbox that overcomes the above identified problems.

Another object of the present invention is to provide a novel quick connect electrode headbox that provides for a rotatable electrode receptacle base.

Still another object of the present invention is to provide a novel quick connect electrode headbox that minimizes the stress on the electrode assembly particularly for mobile applications.

A further object of the present invention is to provide a novel quick connect electrode headbox that facilitates connecting and disconnecting the electrodes from the headbox.

A further object of the present invention is to provide a novel quick connect electrode headbox that provides for removable preprinted or user-customized labels which allow for clear and easy identification of the electrodes connected to the headbox.

A further object of the present invention is to provide a novel quick connect electrode headbox which can be easily configured for packing and transporting.

A further object of the present invention is to provide a novel quick connect electrode headbox which is simple in design and inexpensive to construct, and is durable and rugged in structure.

Still further objects and advantages will become apparent from a consideration of the ensuing description and drawings of the invention.

These and other objects are achieved by a novel quick connect electrode headbox of the present invention. In one form of the invention, a quick connect electrode headbox is provided with an internal assembly positioned within a housing. The internal assembly has at least one circuit board, at least one support attached to the circuit board and a plurality of pivotable electrode receptacle bases pivotably mounted to the at least one support. Further, the plurality of pivotable electrode receptacle bases have a plurality of receptacles each adapted to receive an electrode connector.

DETAILED DESCRIPTION

Figure 1:
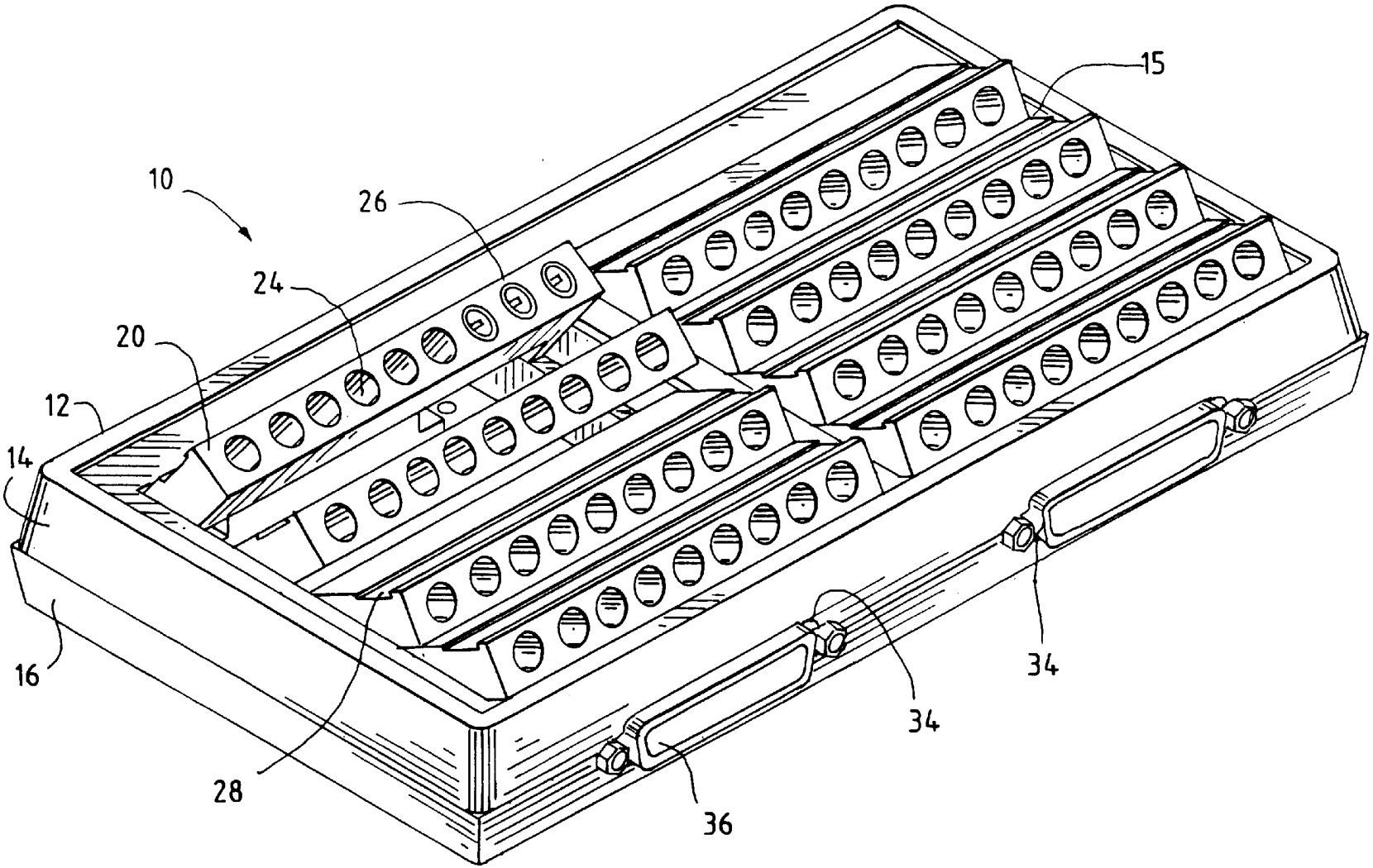
FIG. 1 is a perspective view of one embodiment of the quick connect electrode headbox of the present invention.

FIG. 1 is a perspective view of one embodiment of the quick connect electrode headbox 10 constructed in accordance with the present invention. In FIG. 1, the headbox 10 may comprise a housing 12 having a housing top 14 and a housing bottom 16. The housing 12 may be very compact and in one embodiment may be 4.0" wide, 7.5" long and 1.15" high. Further, in one embodiment the housing 12 may have two apertures 34 on one side of the housing 12 and may have two apertures 35, (e.g., a cutout or opening) on the opposite side of the housing 12 (see FIG. 2). The apertures 34 and 35 may be configured to receive various connectors 36, 38. (For example, but not limited to, "D" type connectors, high-density dsub 44P female 'pass thru' connectors or Honda 50 p 'SCSI-II' or 'mini-centronics' male connectors.) Alternate embodiments may have more or less than two apertures 34 and more or less than two apertures 35 depending on the configuration of the headbox 10 and the user's requirements. Also, housing top 14 may have two apertures 15 (as shown in FIG. 1), e.g. a cutout or opening, or housing top 14 may have more or less than two apertures 15 depending on the user's requirements of headbox 10. The housing 12 may be constructed of plastic or any other material that will provide for proper operation of the headbox 10.

Figure 3:
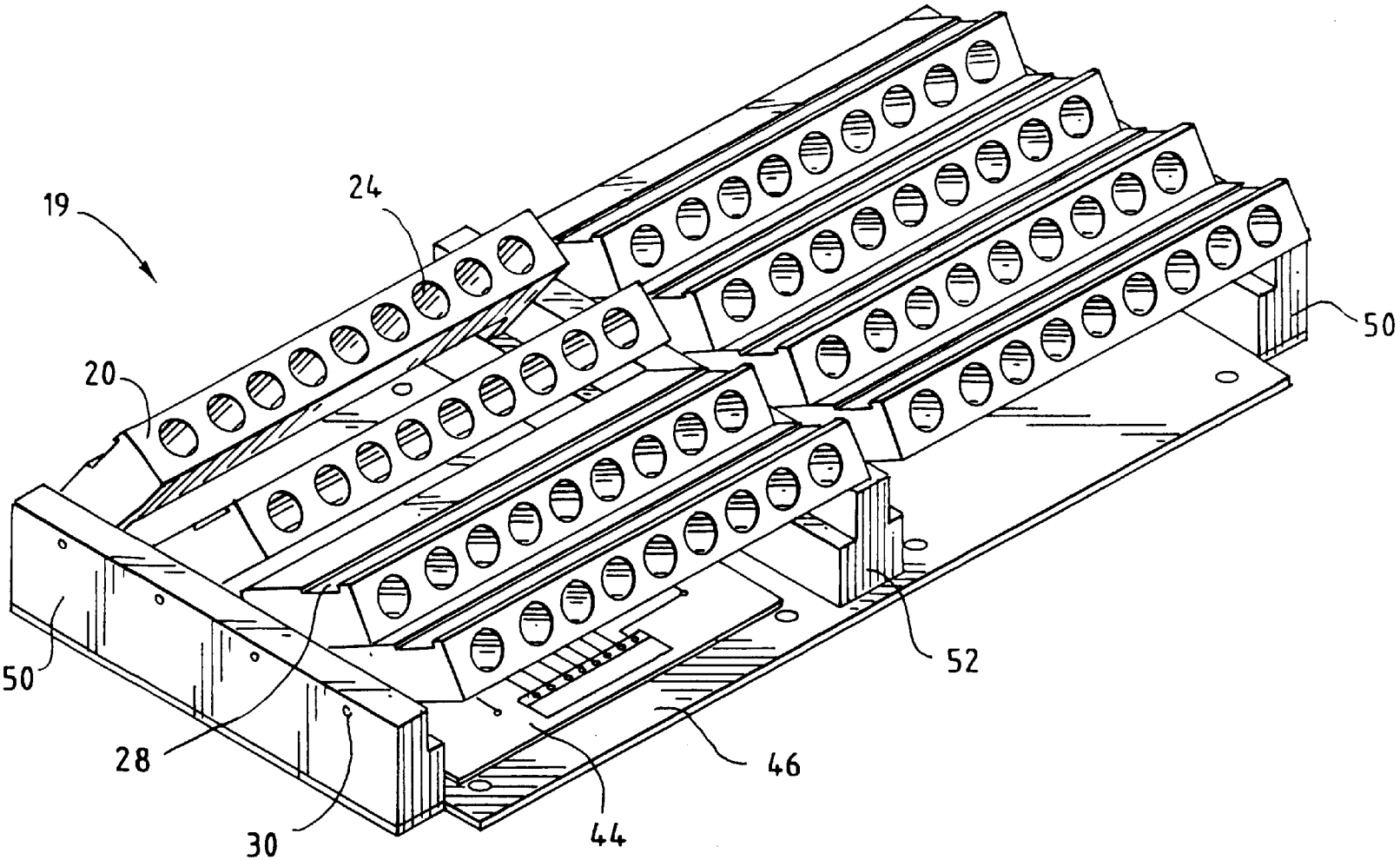
FIG. 3 is a view of one embodiment of the quick connect electrode headbox of FIG. 1 shown without the housing.

As best seen in FIG. 3, located within the housing 12 may be an internal assembly 19. The internal assembly 19, may for example, comprise a plurality of pivotable electrode receptacle bases 20, a plurality of means for pivotably mounting 30, a circuit board 44, a base 46, and end support (s) 50 and middle support(s) 52. In one embodiment, the circuit board 44 may act as the base 46 and in another embodiment, there may be at least one circuit board 44 mounted to the base 46. Alternative embodiments may not use a circuit board. The following descriptions of the various alternate embodiments may use either combination a base 46 and circuit board 44 mounted thereto, or just a circuit board 44 also acting as a base 46. Also, the circuit board 44 is easily disconnected from the headbox should it ever need to be replaced or repaired. One alternate embodiment provides that the supports 50 and 52 may be fixed to the base 46 whereby there is one support 50 located at one end of the base 46 and there is another support 50 located at the opposite end of the base 46 as shown in FIG. 3. Further, in another embodiment, support 52 may be fixed to the base 46 and located between the supports 50. The supports 50 and 52 may, for example, be configured (as shown in FIG. 3) to provide for the pivotable electrode receptacle base 20 to be pivotably mounted to and positioned by the supports 50 and 52 so as to provide for the proper operation of the quick disconnect headbox 10. Further, in one embodiment, fixed to the base 46 may be at least one circuit board 44. The circuit board 44 may, for example, be positioned between the supports 50 and 52 as illustrated in FIG. 3. If only two supports 50 are mounted to the base 46, then at least one circuit board 44 may be mounted to the base and located between the supports 50. The supports 50 and 52 may be constructed of plastic or any other material that will provide for proper operation of the headbox 10.

The pivotable electrode receptacle base 20 may comprise a plurality of electrode receptacles 24 as shown in FIG. 1. In one embodiment, the receptacles 24 (see FIGS. 5 and 6) are configured to receive connectors 26 which may be any connectors that are required for the specific application, e.g., single wire connectors. The connectors 26 are adapted to removably receive electrodes 11 (see FIG. 4) which may be any electrodes that are required for the specific application, e.g. 1.5 mm safety electrodes. Such connectors 26 and electrodes 11 may include conductors in each portion which contact mating conductors in order to couple signals present on one portion to the mating connector portion. The connectors 26 may be connected to the circuit board 44 by, for example, ribbon type connectors or flex circuit type connectors 27.

Figure 2:
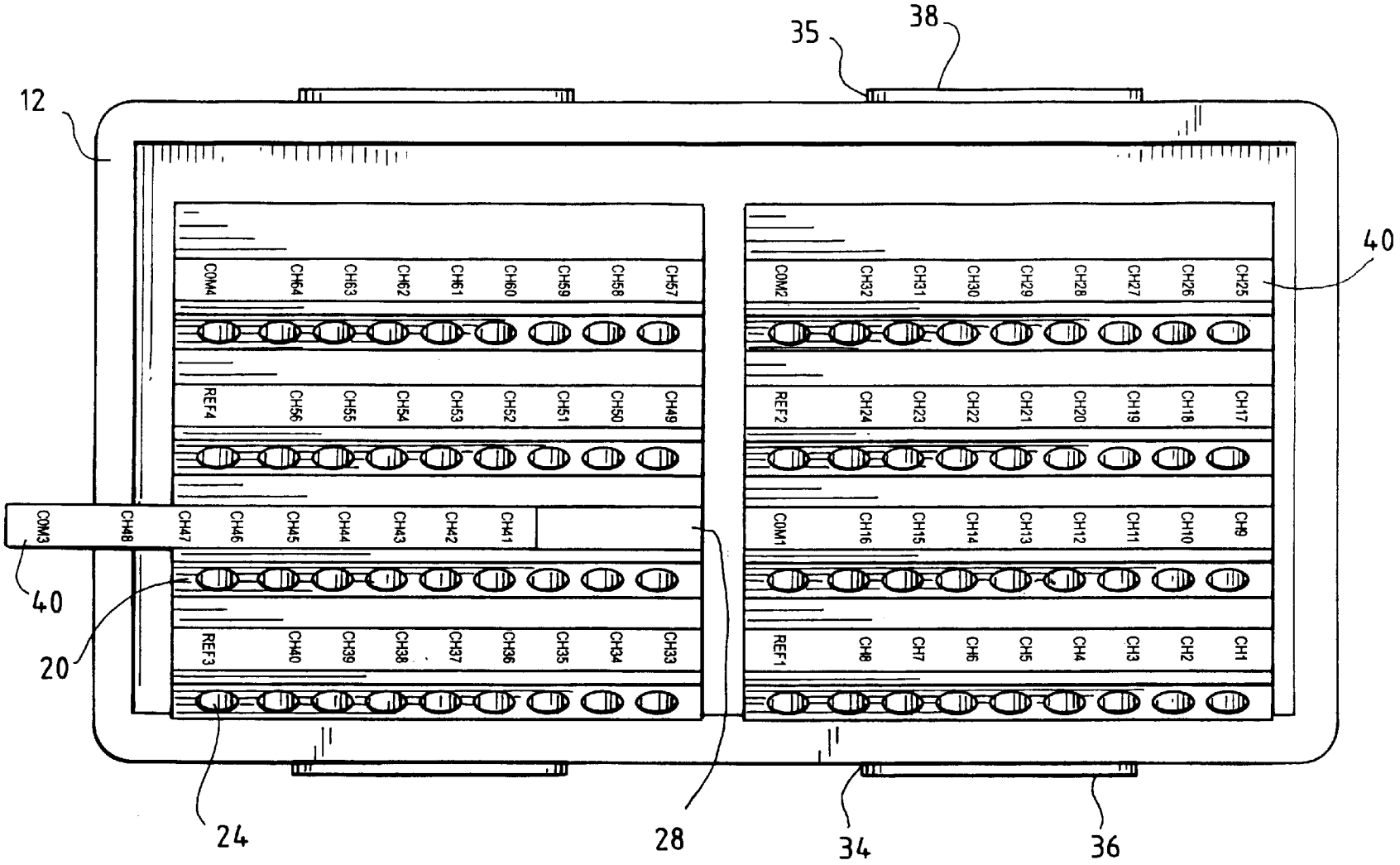
FIG. 2 is a plan view of one embodiment of the quick connect electrode headbox of FIG. 1.
Figure 5:
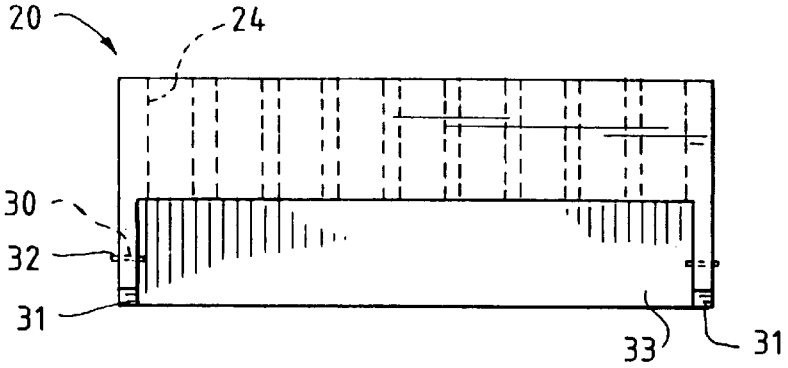
FIG. 5 is a side view of one example of a pivotable electrode receptacle base of the quick connect electrode headbox of FIG. 1.
Figure 6:
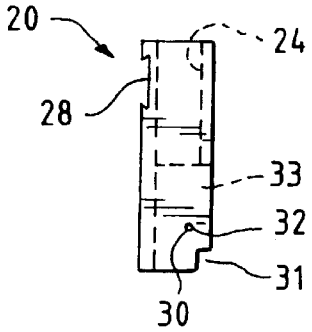
FIG. 6 is an end view of one example of a pivotable electrode receptacle base of the quick connect electrode headbox of FIG. 1.

The receptacle base 20 may have a slot 28 adapted to removably receive a strip label 40 (as best seen in FIG. 2). The slot 28 may be positioned on the receptacle base 20 to provide for an unobstructed view of the strip label 40 when the headbox 10 is in use. The strip label 40 clearly identifies the receptacles 24 so the user knows which electrode 11 to insert into which receptacle 24. Also, the strip label 40 may be, for example, preprinted or customized by the user (e.g. with a marker or pen) for any monitoring application. As best seen in FIGS. 5 and 6, in one embodiment, each end of the base 20 may also comprise a hole 32 configured to receive a means for pivotably mounting 30, for example such as a screw or a pin, that can pivotably mount the base 20 to the support 50 and 52 as shown in FIG. 3. Further, the base 20 may have a notch 31 at each end of the base 20. The placement and size of the notch 31 in combination with the placement of hole 32 and means for pivotably mounting 30 in relation to supports 50, 52 may dictate pivot angles A and B (shown in FIG. 4). Also, base 20 may have a recess 33 that communicates with the plurality of electrode receptacles 24 (see FIGS. 5 and 6). The recess 33 may facilitate connection of the connectors 26 to, for example, the ribbon cable or flex circuit. The ribbon cable or flex circuit is connected to the circuit board 44 by, for example, pcb type connectors. In an alternate embodiment, the recess 33 may be designed such that when the flex circuit, for example, is connected to the connectors 26 the circuit board and pcb connectors are blocked from view when the bases 20 are pivoted to an upright position. Also, the bases 20 may be designed to fit with each other and with the housing 12 such that the circuit board and pcb connectors are blocked from view when the bases 20 are in a downward position. This configuration may be aesthetically desirable and may minimize foreign matter, such as spills, from entering the inside of the quick connect headbox 10. In other alternate embodiments, the receptacle base 20 may be any size, shape or configuration that will provide for pivotable connection of the electrodes 11 to the headbox 10. In yet other alternate embodiments, the recess 33 and flex circuit may be designed to provide a torque that may keep the bases 20 from pivoting on their own to an upright position. The direction of the torque is such that it may cause the bases 20 to pivot toward a downward position. Further, the receptacle base 20 may be constructed of plastic or any other material that will provide for proper operation of the headbox 10.

Figure 4:
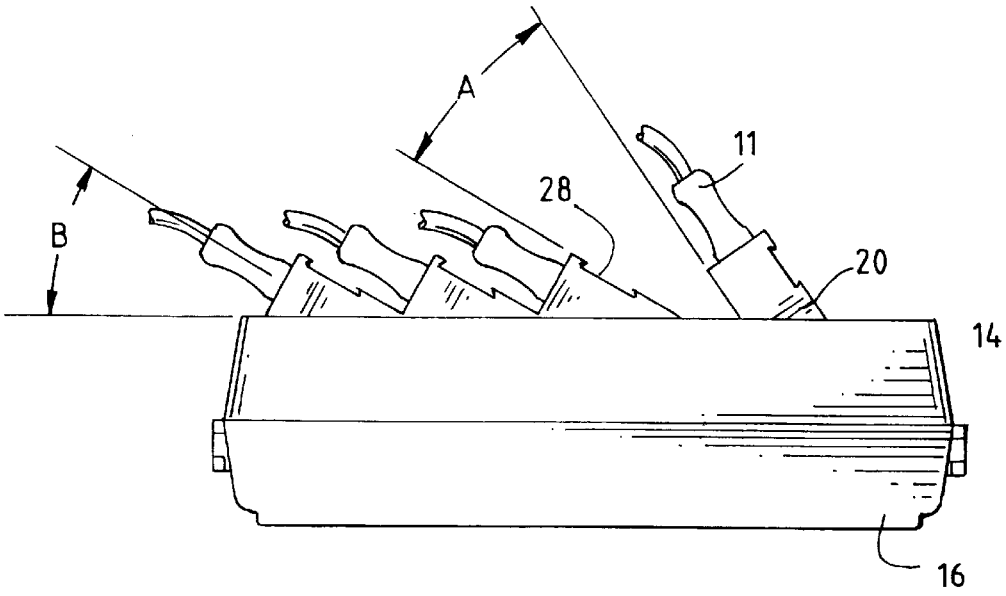
FIG. 4 is a side view of one embodiment of the quick connect electrode headbox of FIG. 1.

As shown in FIG. 4, the base 20 can pivot about the means for rotatably mounting 30 (shown in FIG. 3). In one embodiment, angle A and angle B may be 25 degrees and 30 degrees respectively or any other angles that will provide for proper operation of the headbox 10. In alternate embodiments, Angles A or B may vary so as to minimize the stress on electrodes 11 while maximizing the ease with which a user can reach and grab a particular electrode 11.

When using the electrode headbox 10, labels 40 are selected for the specific monitoring procedure and are inserted into the appropriate slots 28. Then, an electrode 11 is chosen and the appropriate receptacle 24 and connector 26 are identified by the corresponding information on the label 40. This identification process is quick and easy because the orientation of the labels 40 in combination with the location and orientation of the electrode receptacles 24 provide easy viewing and identification of the respective labels 40. Once the corresponding connector 26 is identified, the respective electrode base 20 is then pivoted to the vertical position desired by the user to facilitate connection of the electrode 11 and the appropriate connector 26. The electrode 11 is then "plugged in" (connected) to the connector 26. This procedure is repeated until all of the electrodes 11 are "plugged in" to the respective connectors 26. The pivotable base 20 design makes it very easy for the user to connect (or disconnect) any electrode 11 to any connector 26 even when there are many electrodes 11 connected to many connectors 26 which are located in numerous bases 20. Once all of the electrodes 11 are connected to the headbox 10, the pivotable bases 20 may be pivoted to a position(s) to minimize stress on and greatly reduce the chance of breakage of the electrodes 11. Also, the appropriate connectors 36 and 38 are connected to the headbox 10 and provide a link from the headbox 10 to the appropriate monitoring device(s).

When the monitoring procedure is completed, the electrodes 11 are disconnected from the headbox 10. If the headbox 10 is going to be stored or packed for transport, the bases 20 may be pivoted so as to minimize the height of the headbox 10 thereby giving the headbox 10 a very low "profile". In one embodiment, when the bases 20 are pivoted to their lowest positions the headbox 10 may be only 1.5" high.

Specific embodiments of novel methods and apparatus for construction of novel quick connect electrode headboxes according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. An electrode connection headbox comprising:

a base;

a first electrode receptacle pivotably mounted about a first axis to the base, the first electrode receptacle adapted to receive electrodes in spaced side-by-side relationship along a length of the first electrode receptacle;

a second electrode receptacle pivotably mounted about a second axis to the base, the second electrode receptacle adapted to received electrodes in spaced side-by-side relationship along a length of the second electrode receptacle; and the first axis and the second axis being aligned in parallel side-by-side relationship.

2. The electrode connection headbox of claim 1, wherein the first axis is parallel to the length of the first electrode receptacle.

3. The electrode connection headbox of claim 1, wherein the second axis is parallel to the length of the second electrode receptacle.

4. The electrode connection headbox of claim 1, at least one circuit board secured to the base and being electrically coupled to at least one of the first electrode receptacle and the second electrode receptacle.

5. The electrode connection headbox of claim 1, the first electrode receptacle and the second electrode receptacle being independently pivotable with respect to each other.

6. The electrode connection headbox of claim 1, at least one of the first electrode receptacle and the second electrode receptacle including slot configured to receive at least one label.

7. The electrode connection headbox of claim 1, further comprising a third electrode receptacle pivotably mounted about a third axis to the base, the third electrode receptacle adapted to receive electrodes in spaced side-by-side relationship along a length of the third electrode receptacle, the third axis being co-linear with one of the first axis and the second axis, the third electrode receptacle thereby being laterally displaced from the first electrode receptacle and the second electrode receptacle.

8. An electrode connection headbox comprising:

a base, the base having a bottom, a first side support disposed at a first edge of the base, a second side support arranged parallel to the first side support and disposed at a second edge of the base, the first side support and the second side support extending from the bottom;

a first electrode receptacle pivotably mounted to the base between the first side support and the second side support, the first electrode receptacle adapted to receive electrodes in spaced side-by-side relationship along a length of the first electrode receptacle;

a second electrode receptacle pivotably mounted to the base between the first side support and the second side support, the second electrode receptacle adapted to received electrodes in spaced side-by-side relationship along a length of the second electrode receptacle; and the first electrode receptacle and the second electrode receptacle being in parallel side-by-side relationship.

9. The electrode connection headbox of claim 8, at least one circuit board secured to the base and being electrically coupled to at least one of the first electrode receptacle and the second electrode receptacle.

10. The electrode connection headbox of claim 8, the first electrode receptacle and the second electrode receptacle being independently pivotable with respect to each other.

11. The electrode connection headbox of claim 8, at least one of the first electrode receptacle and the second electrode receptacle including a slot configured to receive at least one label.

12. An electrode connection headbox comprising:

a base, the base having a substantially planar bottom, a first side support disposed at a first edge of the base, a second side support arranged parallel to the first side support and disposed at a second edge of the base, a center support disposed between the first side support and the second side support and being arranged substantially parallel to each of the first side support and the second side support, each of the first side support, the second side support and the center support extending substantially perpendicularly from the bottom;

a first electrode receptacle pivotably mounted to the base between the first side support and the center support, the first electrode receptacle adapted to receive electrodes in spaced side-by-side relationship along a length of the first electrode receptacle;

a second electrode receptacle pivotably mounted to the base between the first side support and the center support, the second electrode receptacle adapted to receive electrodes in spaced side-by-side relationship along a length of the second electrode receptacle;

the first electrode receptacle and the second electrode receptacle being in parallel side-by-side relationship; and a third electrode receptacle pivotably mounted to the base between the center support and the second side support, the third electrode receptacle adapted to receive electrodes in spaced side-by-side relationship along a length of the third electrode receptacle.

13. The electrode connection headbox of claim 12, at least one circuit board secured to the base and being electrically coupled to at least one of the first electrode receptacle, the second electrode receptacle and the third electrode receptacle.

14. The electrode connection headbox of claim 12, the first electrode receptacle, the second electrode receptacle and the third electrode receptacle being independently pivotable with respect to each other.

15. The electrode connection headbox of claim 12, at least one of the first electrode receptacle, the second electrode receptacle and the third electrode receptacle including a slot configured to receive at least one label.

* * * * *